US007967555B2

(12) United States Patent
Gagnon, Jr. et al.

(10) Patent No.: US 7,967,555 B2
(45) Date of Patent: Jun. 28, 2011

(54) PROCESS TO CAST SEAL SLOTS IN TURBINE VANE SHROUDS

(75) Inventors: Ronald R. Gagnon, Jr., Tolland, CT (US); John R. Farris, East Hartford, CT (US); Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 887 days.

(21) Appl. No.: 11/639,455

(22) Filed: Dec. 14, 2006

(65) Prior Publication Data

US 2008/0145226 A1 Jun. 19, 2008

(51) Int. Cl.
*F01D 25/26* (2006.01)

(52) U.S. Cl. ..... 415/134; 415/136; 415/139

(58) Field of Classification Search ..... 415/134, 415/136, 137, 138, 139, 135, 195, 191, 189
See application file for complete search history.

(56) References Cited

U.S. PATENT DOCUMENTS

| | | | | |
|---|---|---|---|---|
| 3,029,485 | A | 4/1962 | McCormick | |
| 3,728,041 | A * | 4/1973 | Bertelson | 415/189 |
| 3,970,318 | A * | 7/1976 | Tuley | 277/641 |
| 5,290,143 | A * | 3/1994 | Kington et al. | 415/191 |
| 5,971,703 | A * | 10/1999 | Bouchard | 415/135 |
| 6,210,111 | B1 | 4/2001 | Liang | |
| 7,093,645 | B2 | 8/2006 | Grunstra et al. | |
| 7,234,506 | B2 | 6/2007 | Grunstra et al. | |
| 7,278,460 | B2 | 10/2007 | Grunstra et al. | |

FOREIGN PATENT DOCUMENTS

| | | |
|---|---|---|
| EP | 1 013 880 A2 | 8/1999 |
| EP | 1 671 720 A1 | 6/2006 |

OTHER PUBLICATIONS

European Search Report for 07254616.1—2122 dated Mar. 27, 2008.
Extended European Search Report for 07254616.1—2122 / 1935531 dated Jul. 4, 2008.

* cited by examiner

*Primary Examiner* — Edward Look
*Assistant Examiner* — Dwayne J White
(74) *Attorney, Agent, or Firm* — Bachman & LaPointe, P.C.

(57) ABSTRACT

A process for casting a turbine engine component is provided. The process comprises the steps of placing a refractory core assembly comprising two intersecting plates in a die, encapsulating the refractory core assembly in a wax pattern having the form of the turbine engine component, forming a ceramic shell mold about the wax pattern, removing the wax pattern, and pouring molten material into the ceramic shell mold to form the turbine engine component.

12 Claims, 3 Drawing Sheets

PROCESS TO CAST SEAL SLOTS IN TURBINE VANE SHROUDS

BACKGROUND OF THE INVENTION (1) Field of the Invention

The present invention is directed to a process for casting seal slots in turbine engine components, such as turbine vane shrouds, and to a cast turbine engine component having seal slots for improving the sealing mechanisms in the turbine engine component and thereby minimizing leakage from the flow path out through the vane shrouds.

(2) Background

In order to avoid the large thermally induced hoop stresses in outer and inner shrouds of full hoop turbine vane rings, vanes are typically cast and machined as separate segments, containing two or more airfoils, with feather seals installed in slots along the vane shrouds in order to minimize the leakage between the segments. When the use of a continuous vane ring is possible, the inner or outer shrouds may be sliced between the airfoils at regular intervals during the final machining operations, or cast with a slip joint which allows for relative motion between the one end of the vane and the mating shroud. In a full vane ring configuration, the incorporation of feather seals is not practical due to the lack of access to the side faces, or the long cycle times, complexity, and high cost of producing a feather seal slot using an EDM process (plunging the electrode from one of the axial surfaces).

The ability to produce the shroud gaps and the imbedded seal slots as an as-cast feature could provide significant lead-time and cost reductions. In addition, a cast slot will have a better surface finish than one produced by EDM, which would also contribute to minimizing leakage.

The use of ceramic cores to cast a seal slot in the shroud of a typical vane ring would not produce much success. The small, thin size required for both the main body of the core and any locating or holding feature would not result in sufficient strength to produce acceptable casting yields.

SUMMARY OF THE INVENTION

In accordance with the present invention, there is provided a process for casting a turbine engine component. The process broadly comprises the steps of: placing a refractory core assembly comprising two intersecting plates in a die; encapsulating the refractory core assembly in a wax pattern having the form of the turbine engine component; forming a ceramic shell mold about the wax pattern; removing the wax pattern; and pouring molten material into the ceramic shell mold to form the turbine engine component.

Further, in accordance with the present invention, there is provided a refractory metal core assembly for use in casting a seal slot in a turbine vane shroud. The refractory metal core assembly broadly comprises a first core plate having a first surface and a second surface opposed to the first surface; a first slot in the second surface; and a second core plate having a mating portion which fits into the first slot.

Still further, in accordance with the present invention, there is provided a turbine engine component comprising an inner shroud ring, an outer shroud ring, a plurality of airfoils extending between the inner and outer shroud rings, and at least one as-cast slot and at least one as cast split line in one of the shroud rings.

Other details of the process for casting seal slots in turbine vane shrouds, as well as other objects and advantages attendant thereto, are set forth in the following detailed description and the accompanying drawings wherein like reference numerals depict like elements.

DETAILED DESCRIPTION OF THE PREFERRED EMBODIMENT(S)

The present invention is directed to process for providing a turbine engine component configuration that maximizes durability and minimizes leakage. The process described herein can be used with a variety of turbine flow path alloys, full ring or segmented vanes.

Figure 1:
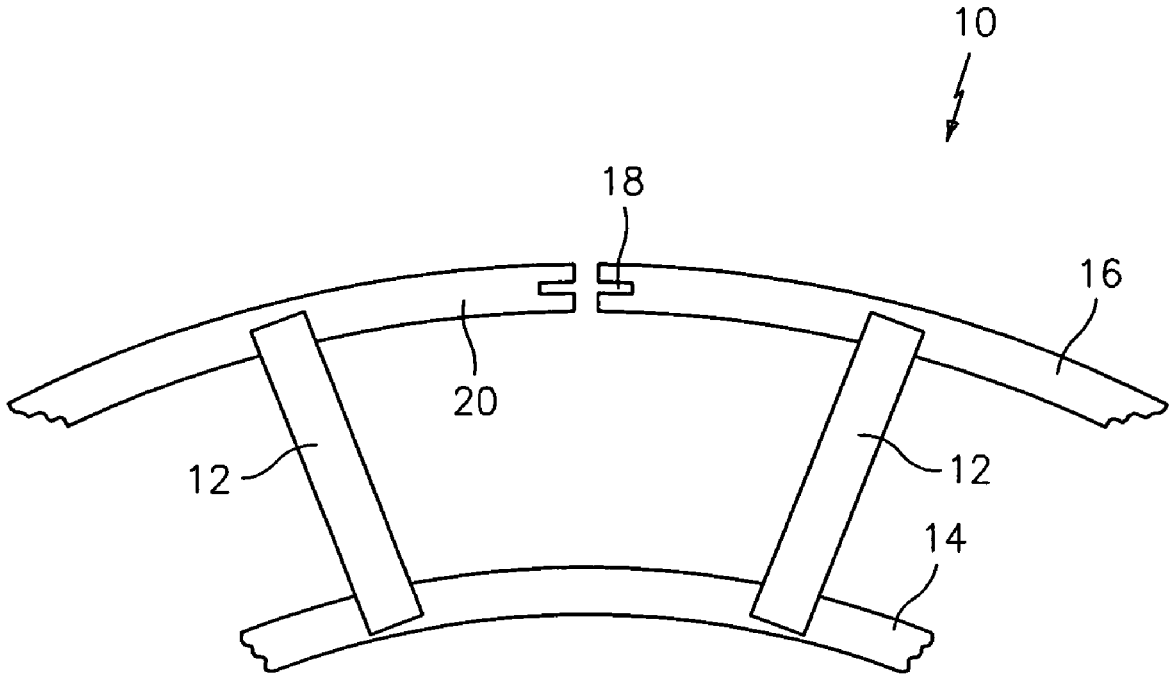
FIG. 1 illustrates a portion of a vane ring used in a turbine engine component.

A vane ring 10 such as that shown in FIG. 1 has a plurality of airfoils 12 which extend between an inner shroud ring 14 and an outer shroud ring 16. The vane ring 10 is typically annular in shape. The vane ring 10 can be produced using an equiaxed alloy, a directionally solidified alloy, or a single crystal alloy. A combination of any two of these types of alloys can be used to produce a bi-cast or dual alloy process. For a useful bi-cast configuration, the individual airfoils 12 may be first cast from a single crystal material, such as a single crystal nickel based superalloy, and then the shrouds 14 and 16 may be cast around the airfoils 12 using an equiaxed or directionally solidified alloy having a lower melting temperature than the single crystal alloy used for the airfoils. The use of such a bi-cast process is desirable in that it allows for optimization of the crystal orientation within the airfoils 12 and maximizes temperature capability. The airfoils 12 may be solid; however, for high temperature applications, the airfoils 12 may be cooled and therefore contain internal cavities (not shown). The internal cavities may be produced using refractory metal cores, conventional ceramic cores, or any other suitable technique known in the art.

In the past, the bi-cast process was used in a way that locked the airfoils within one of the shrouds, typically the inner shroud, but allowed the other end of the airfoil to move and grow radially during engine operation. Without allowing this degree of freedom, the airfoils and the shroud rings could not withstand the thermally induced stresses. However, this loose joint, usually produced by the application of a ceramic or oxide layer during the casting process, results in a significant leak path around the edge of every airfoil.

An alternative way to address the thermal stress problem in full hoop vane rings is to incorporate one or more slots in one of the shroud rings, typically the outer shroud ring. In the past, this was done during final machining by a wire EDM or conventional machining process that slices the shroud at regular intervals, either between all airfoils or between multiple airfoil groups. The slot would be sized to allow for closure at the maximum temperature condition. Such a method could be used either for a full vane ring of a homogeneous alloy produced by a single casting operation or for a bi-cast vane ring as previously described. With the addition of machined slots in one of the shrouds, both ends of the airfoils can now be locked within the shroud during the casting process (by omitting the slip joint between the ends of the airfoils and the shrouds). This allows for no movement of the airfoils independent of the shrouds (for thermal stress relief), but it also eliminates the large leak path around each airfoil. The slots in the outer shroud become the thermal stress relief mechanism, allowing the airfoils to grow outward and the shroud to bow at controlled regular intervals. However, these slots also become the primary leak path for this vane ring.

Figure 2:
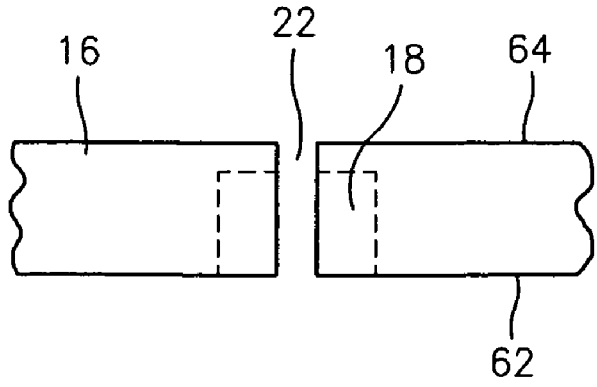
FIG. 2 illustrates a top view of a portion of the vane ring of FIG. 1.

Referring now to FIG. 2, in accordance with the process of the present invention, one or more as-cast feather seal pockets or slots 18 may be produced in a wall 20 of the outer shroud ring 16 in between two adjacent airfoils 12. Each pocket 18 may be cast integrally with a shroud split line 22 using a refractory metal core assembly 30 in accordance with the present invention.

The refractory metal core assembly 30 used to produce the pocket 18 and the intersecting shroud split line 22 is shown in FIGS. 3-8. The refractory metal core assembly 30 is formed from two thin plates 32 and 34. As shown in FIGS. 3-5 and 8, the thin plates 32 and 34 are constructed so they can be interlocked perpendicular to each other. As can be seen from FIG. 7, the plate 32 has a first surface 80 and a second surface 82 opposed to the first surface 80. A slot 50 is cut into the second surface 82. As can be seen from FIG. 6, the plate 34 has a first surface 84 and a second surface 86 opposed to the first surface 84. A slot 52 is cut or formed into the second surface 86. The slots 50 and 52 form mating portions which allow the plates 32 and 34 to be interlocked perpendicular to each other when joined together.

Each of the plates 32 and 34 may be formed from a refractory metal or refractory metal alloy. While the plates 32 and 34 may typically be formed from molybdenum or a molybdenum alloy, they could be formed from any suitable refractory material. If desired, each plate 32 and 34 may have a thin ceramic coating applied to the base refractory metal, refractory metal alloy, or refractory material forming the respective plate. Each of the plates 32 and 34 is solid.

The plate 32 has a circular aperture or locating feature 54 which allows the plate and the core assembly to be secured in a wax die. Still further, the plate 32 forming the split in the shroud ring is the longer of the two plates 32 and 34. The plate 32 creates a shroud split line 22 that runs the entire axial length of the shroud ring wall 20. The plate 34 that forms the seal slot or pocket 18 is the shorter of the two plates. It preferably creates a slot or pocket 18 that runs from a top face 62 of the shroud ring 16 and bottoms out before an aft end 64 of the shroud ring 16. Forming a seal pocket 18 that is closed at one end is important to minimizing the leakage down the shroud ring 16. The pocket 18 is typically open for feather seal installation. The engine assembly could include an upstream mating part in contact with the top of the vane ring shroud 16 that would cover the top of the pocket 18 to assure the seals are retained, and to close this leak path.

As an alternative approach, to assure a tighter control of the shroud split line 22, the seal pocket 18 could be produced as an as-cast feature without the split lines 22 included using one piece core consisting of plate 34 only. The split line could then be produced as a more precisely controlled machined feature. Alternatively, the split line could be included but cast undersized, using a thinner plate 32, to providing better core locating control during the casting process, while still taking advantage of the more precise machining process to create the final split line dimension.

This configuration, when the width of the split line 22 is minimized based on predicted thermal growth, and the dimensions of the seal pocket 18 are optimized based on the feather seal design, provides for a minimum amount of leakage through the shroud wall, while still allowing for relief of the thermal stress. Further optimization could result by reducing the number of slot split lines 22, rather than including them between all of the airfoils. As opposed to attempting to EDM the seal pockets 18, producing them as a cast feature greatly reduces the cost, lead time and variability. In addition the casting process will result in a better surface finish with the seal pocket 18, which is important in maximizing the sealing capability of the feather seal. Since the shroud split lines 22 are formed at the same time as the seal pockets, a subsequent machining operation is saved.

Figure 4:
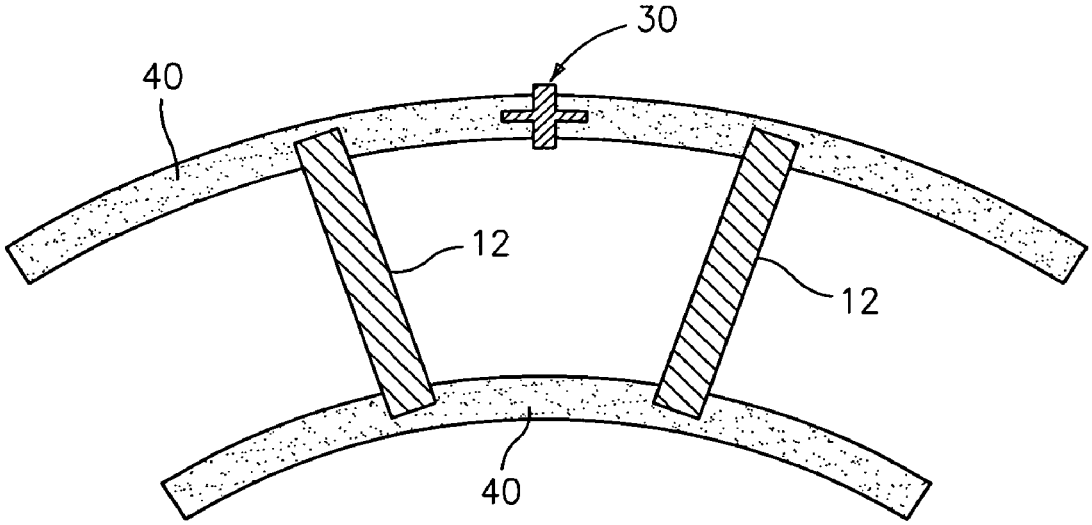
FIG. 4 is a sectional view of a refractory metal core assembly for forming a cast seal slot embedded within a wax pattern within a die.
Figure 5:
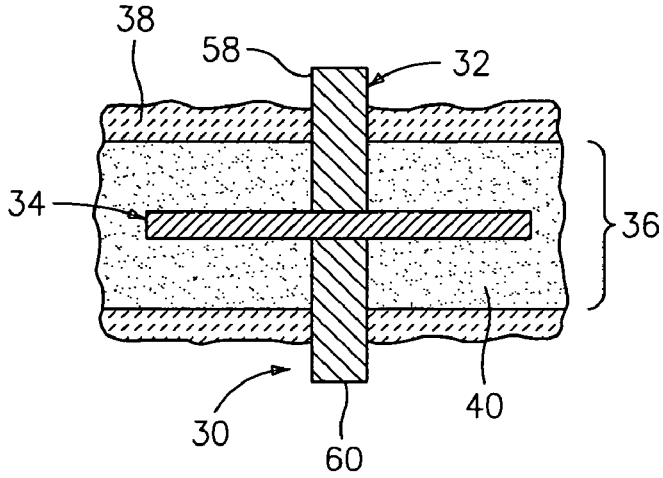
FIG. 5 is an enlarged view of the embedded refractory metal core assembly of FIG. 4.
Figure 6:
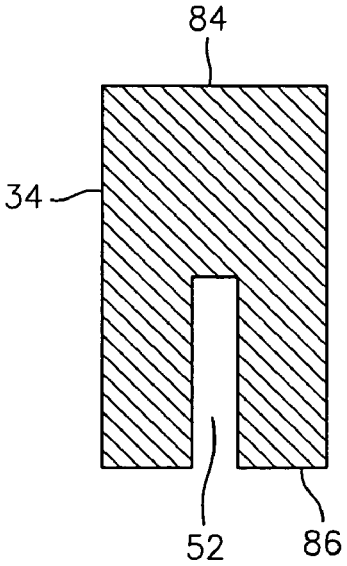
FIG. 6 shows a first plate used in the refractory metal core assembly of the present invention.
Figure 7:
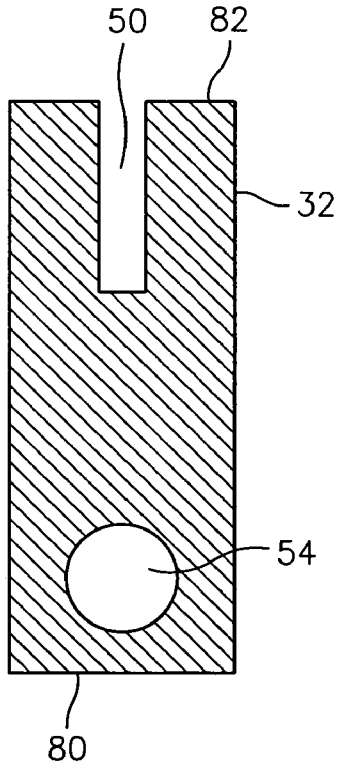
FIG. 7 shows a second plate used in the refractory metal core assembly of the present invention.
Figure 8:
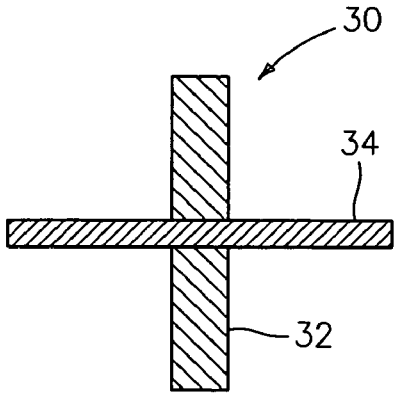
FIG. 8 illustrates a top view of the refractory core assembly of the present invention.

In order to form a turbine engine component such as that shown in FIGS. 1 and 2, one or more refractory metal core assembly 30 are first installed in a shroud cavity 36 of a wax die 38 as shown in FIGS. 4 and 5. The wax die 38 may be formed from any suitable material known in the art. After being positioned in the shroud cavity 36 of the wax die, each refractory metal core assembly 30 may be held during the wax injection process by the locating feature 54. Wax may be injected into the die 38 using any suitable technique known in the art. After the wax injection process has been completed, a wax pattern 40, such as that shown in FIGS. 4 and 5 is formed. As can be seen from these figures, the wax pattern 40 which is formed is in the shape of the airfoils 12 and the shroud rings 14 and 16 to be cast. Also, as can be seen from these figures, the refractory metal core assembly 30 is substantially embedded within the wax pattern 40. There are portions 58 and 60 of each refractory metal core assembly 30 that extend beyond the wax pattern 40. These portions are exposed during the dipping process used to form the wax pattern 40.

Figure 3:
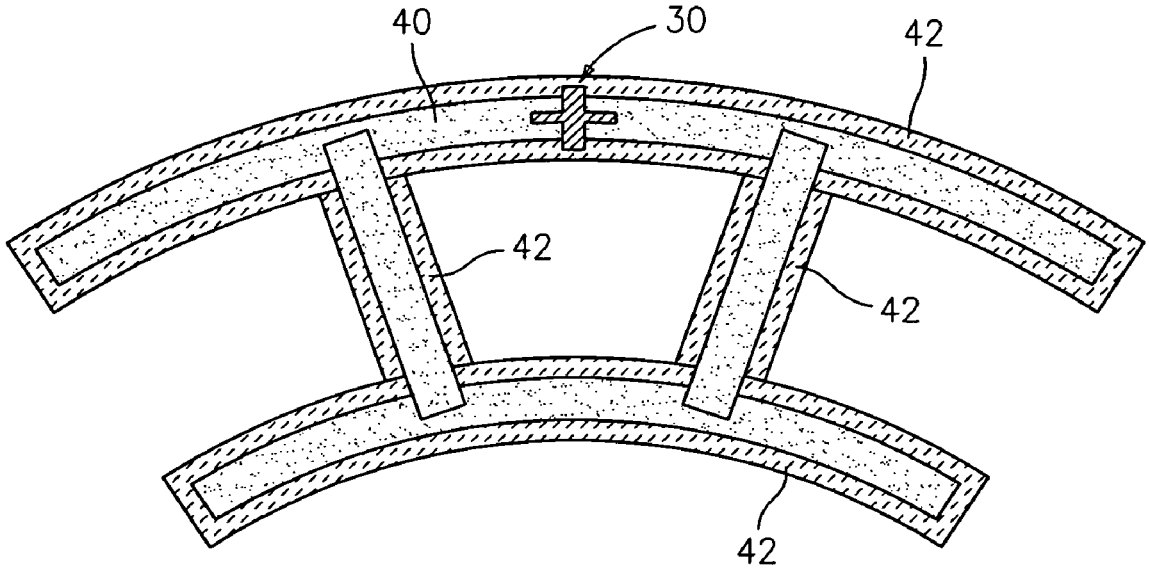
FIG. 3 illustrates a sectional view of a portion of a vane ring mold after shell dip.

Referring now to FIG. 3, a ceramic shell 42 is formed about the wax pattern 40. The ceramic shell 42 may be formed using any suitable technique known in the art such as with a dipping process. Additionally, the ceramic shell 42 may be formed from any suitable ceramic material known in the art. The ceramic shell 42 serves to secure each refractory metal core assembly 30 after the mold is de-waxed, cured, and throughout the pouring and solidification of the metal alloy(s) forming the airfoils 12 and the shroud rings 14 and 16.

After de-waxing and curing, the molten metal alloy material used to form the airfoils 12 and the shroud rings 14 and 16 may be poured into the ceramic mold using any suitable technique known in the art. When a bi-cast process is preferred, two types of alloys with different melting temperatures are used to produce a dual alloy vane ring. For one bi-cast configuration, the individual airfoils 12 may be first cast from a single crystal material, such as a single crystal nickel based superalloy. After solidification, the individual airfoils may be removed from the ceramic shell and processed through normal casting finishing operations. A set of airfoils may then be placed in a separate die that locates them in a ring for wax injection of the shroud forms. Subsequent to the typical ceramic shell dipping process, and the wax burn out operation, the ceramic mold, with the cast airfoils imbedded, are brought to the mold pre-heat temperature, and the shrouds 14 and 16 may be cast around the airfoils 12 using an equiaxed or directionally solidified alloy having a lower melting temperature than the single crystal alloy used for the airfoils.

After the airfoils 12 and the shroud rings 14 and 16 have been formed, each refractory metal core assembly 30 may be removed using any suitable technique known in the art, leaving one or more pockets 18 and one or more split line 22. The refractory metal cores may be removed from the solidified vanes rings using an acid leach process.

While the present invention has been described in the context of forming the split lines 22 and pockets 18 in the outer shroud ring 16, one could form the split lines 22 and the pockets 18 in the inner shroud ring 14 if desired.

The vane ring configuration formed by the process of the present invention will have significantly lower leakage than the state-of-the art bi-cast methods currently available due to elimination of the irregular, unsealed operating gap around the perimeter of the airfoils as they pass through the shroud, replacing that gap with a controlled sealed slot.

It is apparent that there has been provided in accordance with the present invention a process for casting seal slots in turbine vane shrouds which fully satisfies the objects, means, and advantages set forth hereinbefore. While the present invention has been described in the context of specific embodiments thereof, other unforeseeable alternatives, modifications, and variations, will become apparent to those skilled in the art having read the foregoing description. Accordingly, it is intended to embrace those unforeseeable alternatives, modifications, and variations as fall within the broad scope of the appended claims.

What is claimed is:

1. A turbine engine component comprising:

an inner shroud ring;

an outer shroud ring;

a plurality of airfoils extending between said inner and outer shroud rings; and at least one as-cast slot and at least one split line being present in only one of said shroud rings, said at least one split line creating at least two non-overlapping segments in said one shroud ring.

2. The turbine engine component of claim 1, wherein each said split line is an as-cast split line.

3. The turbine engine component according to claim 1, wherein said at least one as-cast slot and said at least one split line is formed in said outer shroud ring.

4. The turbine engine component according to claim 1, wherein each said as-cast slot and each said as-cast split line is located between adjacent ones of said airfoils.

5. The turbine engine component according to claim 1, wherein said airfoils are formed from a first material and said shroud rings are formed from a second material different from said first material.

6. The turbine engine component according to claim 5, wherein said airfoils are formed from a single crystal alloy.

7. The turbine engine component according to claim 6, wherein said shroud rings are formed from one of an equiaxed alloy and a directionally solidified alloy.

8. The turbine engine component according to claim 1, wherein said shroud rings and said airfoils are each formed are formed from the same alloy.

9. The turbine engine component of claim 8, wherein said alloy is selected from the group consisting of an equiaxed alloy, a directionally solidified alloy, and a single crystal alloy.

10. The turbine engine component according to claim 1, wherein each said split line extends an entire axial length of a wall of the shroud ring.

11. The turbine engine component according to claim 1, wherein each said slot is open at one end and closed at a second end.

12. The turbine engine component according to claim 1, wherein each said slot has a closed end which is spaced from an aft end of said shroud ring.

* * * * *